United States Patent [19]

Head

[11] Patent Number: 4,568,857

[45] Date of Patent: Feb. 4, 1986

[54] FLUORESCENT LIGHT CONTROLLER

[75] Inventor: William J. Head, West Hill, Canada

[73] Assignee: Honeywell Ltd., Canada

[21] Appl. No.: 548,523

[22] Filed: Nov. 3, 1983

[30] Foreign Application Priority Data

Nov. 9, 1982 [CA] Canada ..... 415232

[51] Int. Cl.[4] ..... H05B 41/38; H05B 41/392

[52] U.S. Cl. ..... 315/105; 315/194; 315/195; 315/244; 315/DIG. 4

[58] Field of Search ..... 315/291, 244, 105, DIG. 4, 315/194, 195

[56] References Cited

U.S. PATENT DOCUMENTS

| | | | |
|---|---|---|---|
| 2,429,415 | 10/1947 | Lemmers | 315/244 X |
| 3,529,207 | 9/1970 | Webb | 315/105 X |
| 4,352,045 | 9/1982 | Widmayer | 315/291 |
| 4,371,812 | 2/1983 | Widmayer | 315/291 |
| 4,464,610 | 8/1984 | Pitel | 315/291 |

FOREIGN PATENT DOCUMENTS

| | | | |
|---|---|---|---|
| 742805 | 9/1966 | Canada . | |
| 52-5986 | 1/1977 | Japan | 315/291 |

OTHER PUBLICATIONS

Burkhart et al., "Reverse Phase Controlled Dimmer for Incandescent Lighting", IEEE Trans. on Industry Applications, vol. I-A 15, No. 5, Sep. 1979, pp. 579-583.

Ernst et al., "Illumination Control Circuit", IBM Technical Disclosure Bulletin, vol. 20, No. 12, May 1978, pp. 5132-5133.

*Primary Examiner*—David K. Moore
*Assistant Examiner*—Vincent DeLuca
*Attorney, Agent, or Firm*—Trevor B. Joike

[57] ABSTRACT

A dimming system for fluorescent tubes wherein counter electromotive forces generated during switch off of the tubes are used to maintain filaments of the fluorescent tubes heated during switch off periods of the tube, the dimming system having source terminals for connection to a source of power, the power having zero phases, load terminals for connection to the fluorescent tubes, a switch connected to the source terminals and to the load terminals for controlling the supply of power to the load terminals, a zero phase firing circuit connected to the switch for energizing the switch to supply power to the load terminals at the zero phases, a phase turn off circuit connected to the switch for deenergizing the switch to switch off power to the load terminals at phases of the power other than the zero phases, and a switch off filament heating control circuit connected to the switch for converting counter electromotive forces generated at switch off of the tube into power for supply to the filaments during switch off.

16 Claims, 14 Drawing Figures

FLUORESCENT LIGHT CONTROLLER

BACKGROUND OF THE INVENTION

The present invention relates to a controller for fluorescent tubes wherein the tube is energized at the zero phase of the current, voltage or power cycle and wherein the tube is dimmed by turning off the tube at a phase angle selected to produce the desired amount of dimming. More particularly, the present invention relates to such a system wherein the counter electromotive switching spikes generated as a result of phase turn off of a reactive type load such as that found with respect to fluorescent tubes are converted into power pulses which are utilized during switch off intervals to achieve corrective work functions such as maintaining the filaments of a fluorescent tube heated during the switch off intervals. The present invention is particularly useful in the control of rapid start ballast fluorescent lighting systems.

Heretofore, most controllers of inductive fluorescent lighting loads have energized these loads at a variable phase angle turn on point and allowed natural commutation, i.e. the zero crossover point in the current and/or voltage cycle, to switch off the load. Other controllers have turned the fluorescent lighting loads on at the zero crossover point and have turned the loads off at a selected phase angle to yield the desired amount of lighting control.

Phase angle turn on controllers, i.e. controllers of the first type described above, which power rapid start ballast fluorescent lighting systems have a very limited control range because the regulatory effect of the choke-capacitor components in the ballast tends to counteract any change in RMS load voltage and because there is a rapid drop in fluorescent tube heater voltages as the angle of turn on is increased.

Phase angle turn off controllers, i.e. controllers of the second type, produce a stronger counter electromotive force spike from the rapid start ballast inductance. This spike causes severe acoustic noise and break down of circuit components. Prior art devices have heretofore suppressed this spike with some loss of power. However, rapid start ballast circuits connected to a turn off type of controller employing spike suppression experience low fluorescent tube heater voltages at lower dimming levels resulting in a reduced dimming range.

It has not been possible prior to the present invention to achieve effective and reliable dimming control of rapid start fluorescent ballast lighting systems because the reduced operating voltages imposed upon the fluorescent tube electrodes at lower light levels causes poor tube ignition, causes premature tube drop out, and lessens tube life due to cathode stripping. The regulatory effect offered by the series connected choke and capacitor arrangement in the rapid start ballast opposes attempts to control or modulate the ballast AC input. Extremely high amplitude counter electromotive forces or flyback spikes resulting from the turn off control of rapid start ballast systems causes unacceptable ballast acoustic noise levels, causes poor fluorescent tube crest factors, and endangers circuit components. A further disadvantage of existing control methods is that low light levels are susceptible to light intensity changes caused by line voltage changes.

The present invention overcomes many of these difficulties by utilizing a half wave turn off method wherein the series inductive capacitive regulatory characteristic of the rapid start ballast is overcome. The present invention provides for reshaping and reenforcing of the counter electromotive force wave during the switch off cycle thus producing a much improved quasi-sinusoidal wave power pulse which is used to maintain fluorescent tube heater voltages, provide improved tube ignition, lessen premature tube conduction drop out, improve fluorescent tube life, extend dimming control range, and improve tube crest factors.

SUMMARY OF THE INVENTION

Thus, the improved dimming system for fluorescent tubes wherein counter electromotive forces generated during switch off of the tube are restructured and used to maintain the filaments of the tube heated during these switch off periods includes source terminals for connection to a source of power, the power having zero phases, load terminals for connection to at least one fluorescent tube and ballast, a switch connected to the source terminals and to the load terminals for controlling the supply of power to the load terminals, a zero phase firing circuit connected to the switch for energizing the switch to supply power to the load terminals at these zero phases, a phase turn off circuit connected to the switch for deenergizing the switch to switch off power to the load terminals at phases of the power other than zero phases, and an off period filament heater circuit connected to the switch for converting counter electromotive forces generated at switch off of the tube into power for supply to the filaments during the switch off periods.

BRIEF DESCRIPTION OF THE DRAWINGS

These and other features and advantages will become apparent from a detailed consideration of the invention when taken in conjunction with the drawings in which.

DETAILED DESCRIPTION

Figure 1:
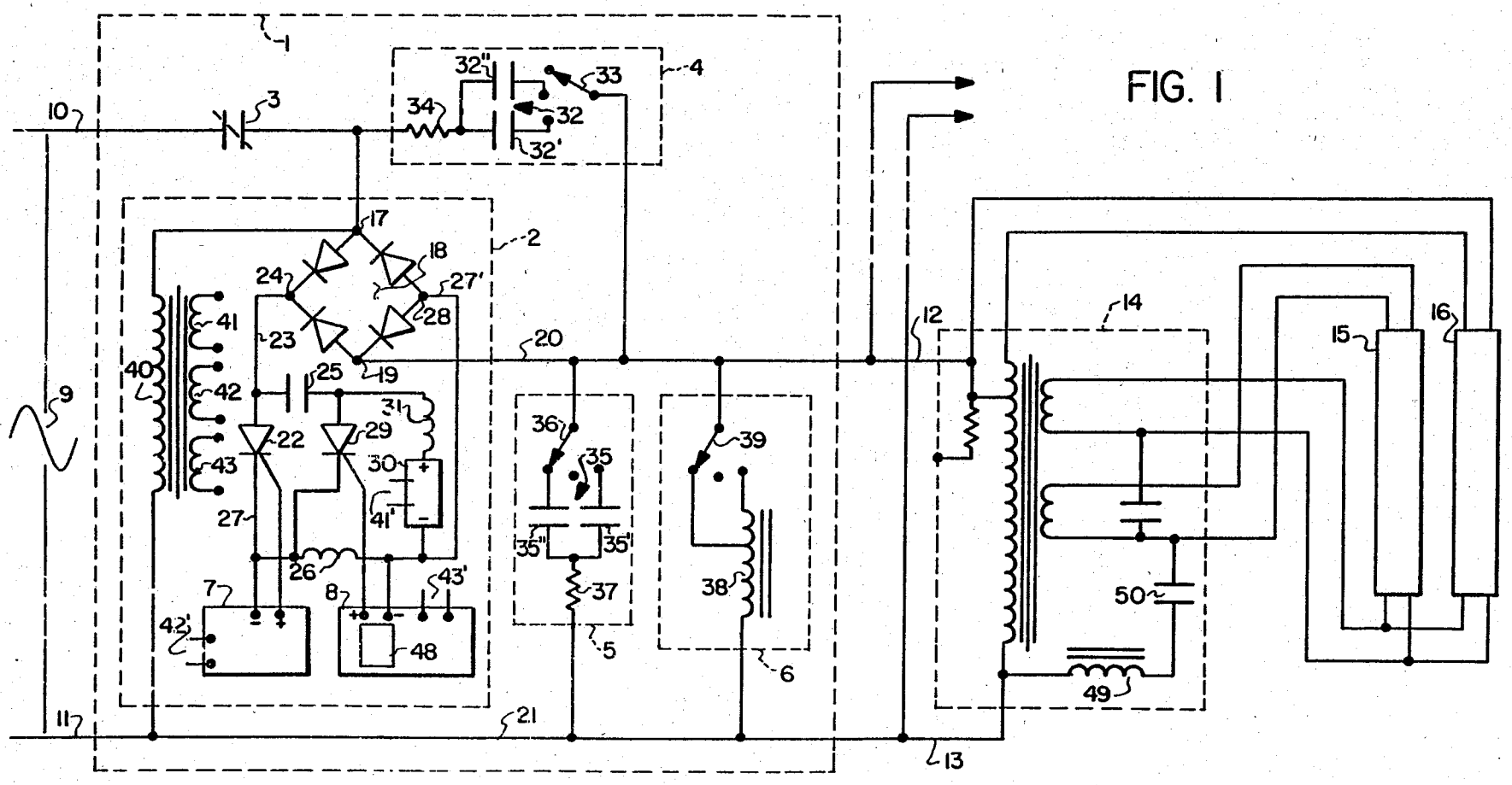
FIG. 1 is a schematic circuit diagram of the fluorescent lighting controller according to the present invention.

In FIG. 1, controller 1 includes phase angle switching circuit 2, contactor 3, partial bypass means 4, current leading wave shaping circuit 5, current lagging wave shaping circuit 6, zero phase turn on circuit 7 and phase turn off circuit 8.

Controller 1 is connected to sinusoidal source of power 9 by way of line conductor 10 and neutral conductor 11 and the output of controller 1 is connected by way of load control conductor 12 and load neutral conductor 13 to a load circuit comprising rapid start ballast 14 connected to fluorescent tubes 15 and 16.

Contactor 3 is connected between line conductor 10 and AC line input arm 17 of bridge rectifier 18, the opposite AC load input arm 19 of which is connected by way of load line 20 and load control conductor 12 to rapid start ballast 14 and associated tubes 15 and 16.

The anode of SCR 22 is connected by line 23 to positive output arm 24 of bridge 18 and also to one terminal of commutation capacitor 25. One end of inductor 26 is connected via line 27 to the cathode of SCR 22, this same end of inductor 26 is also connected to the cathode of SCR 29 and the negative input terminals of circuits 7 and 8. The other end of inductor 26 is connected to the negative terminal of power supply 30 and also via line 27′ to arm 28 of bridge 18. The anode of SCR 29 is connected to the other terminal of commutation capacitor 25 and also to one side of current limiting means 31 the other side of which is connected to the positive terminal of makeup power supply 30.

In order to restructure and use the counter electromotive force voltage spike generated upon turn off of the load consisting of ballast 14 and tubes 15 and 16, bypass circuit 4 is connected around switching circuit 2.

Current leading circuit 32 is a parallel arrangement of capacitors 32′ and 32″ having a common terminal and incremental capacitive tap terminals. The tap terminals of current leading circuit 32 may be selected by switch 33 for connection to line 20. The common terminal of capacitors 32′ and 32″ is connected by way of current limiting resistor 34 to AC line input arm 17 of bridge 18.

To further shape the counter electromotive switching spikes, circuit 5 is connected between line 20 and line 21. Circuit 5 comprises a current leading circuit 35 including a parallel arrangement of capacitors 35′ and 35″ having a common terminal and incremental capacitive tap terminals. The tap terminals are selected by switch 36 for connection to line 20 and the common terminal is connected through current limiting resistor 37 to line 21.

To finally shape the switching spikes, lagging circuit 6 is connected between lines 20 and 21 and includes inductor 38 having one side connected directly to line 21 and the other side connected to a first stationary contact with a second stationary contact connected to a tap of inductor 38. The stationary contacts are selected by switch 39 which is connected to line 20.

Step down transformer 40 has its primary connected between the load side of contactor 3 and neutral line 21. Secondary 41 of transformer 40 is connected to the low voltage input terminals 41′ of makeup power supply 30, secondary 42 of transformer 40 is connected to low voltage input terminals 42′ of zero phase turn on circuit 7, and secondary 43 of transformer 40 is connected to low voltage input terminals 43′ of phase turn off circuit 8. A line voltage compensation circuit 48 can be included in phase turn off circuit 8.

Series connected choke 49 and capacitor 50 are located external to controller 1 as inherent parts of typical rapid start ballasts such as 14 and are wired as series conductors of the lamp arc current.

In operation, contactor 3 functions as a remote controlled electromagnetic switch for providing a positive means of on-off switching. An adjustment in circuit 8 will control the amount of lighting produced by tubes 15 and 16 but contactor 3 determines whether or not the system is on. Upon closure of contactor 3, bridge rectifier 18 becomes conductive between its AC input arm 17 and its AC load input arm 19 under control of SCR 22 series connected with inductor 26 between positive arm 24 and negative arm 28 of the bridge. As a result of contactor 3 closing and bridge 18 being in a conductive mode, AC current will flow from sinusoidal source 9 through line conductor 10, the closed contacts of contactor 3, AC line input arm 17 of bridge 18 and then through a conductively phased diode of bridge rectifier 18 to the phase angle switching circuitry across the positive arm 24 and negative arm 28 of bridge 18. Current then flows through another conductively phased diode of bridge 18 to AC load input arm 19, through line 20, load line 12, ballast 14 and lamps 15 and 16, neutral conductor 13, neutral line 21 and neutral conductor 11 to sinusoidal power source 9. A predetermined amount of current across AC input arm 17 and AC input arm 19 of bridge 18 is bypassed by bypass circuit 4 during the non-conducting time of bridge 18.

Transformer 40 is a step down transformer providing low voltage outputs at secondaries 41, 42 and 43. Winding 41 is connected to input terminals 41′ of makeup power supply 30 which may be a simple rectifier and filter for rectifying the AC low voltage input and delivering it as DC to the output terminals of the power supply 30.

Figure 2:
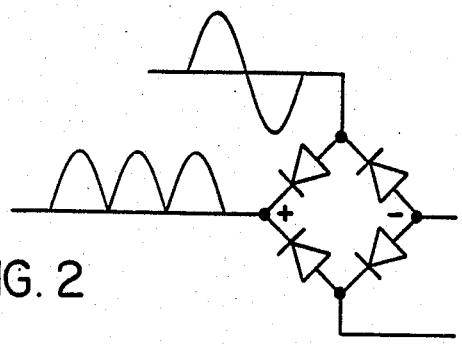
FIG. 2 shows the voltage time characteristic relating the AC bridge input arm and the positive DC output arm of the bridge rectifier portion of FIG. 1 when DC current is not being switched.
Figure 3A:
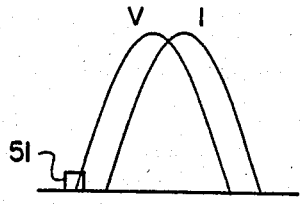
FIGS. 3A–3D shows typical lagging and leading current voltage time characteristics encountered on sinusoidal power lines, and indicating time and power characteristics of a conventional zero crossover pulse versus an improved power pulse of the present invention, and further indicating the respective zero crossover pulse time span relationships to a sinusoidal current and voltage phase shift.
Figure 3B:
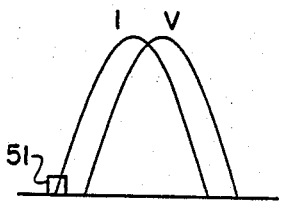
Figure 3C:
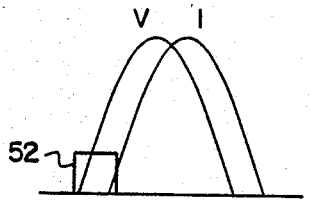
Figure 3D:
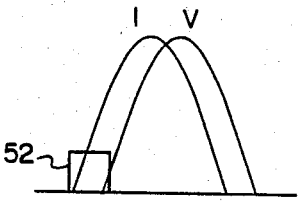

The sinusoidal waves across AC input arm 17 and AC load input arm 19 of bridge 18 are transformed by rectification into half wave DC pulses which are delivered across the positive arm 24 and the negative arm 28 of bridge 18 as illustrated in FIG. 2. SCR 22 and winding 26 are connected in series across the positive arm 24 and the negative arm 28 of bridge 18. The half wave DC pulses appearing across the positive arm 24 and the negative arm 28 of bridge 18 flow through SCR 22 and winding 26 during predetermined SCR 22 on time segments of the half waves, these segments being established by the control of zero phase turn on circuit 7 and phase turn off circuit 8.

The turn on of SCR 22 is accomplished by a turn on pulse at near zero crossover, the turn on pulse being delivered from turn on circuit 7 to the gate of SCR 22. Ordinarily, zero cross pulse devices generate comparatively narrow pulses which are prone to produce unreliable SCR latching particularly in reactive circuits wherein a current-voltage phase shift occurs. FIGS. 3A-3D depict conventional zero crossover pulses 51 versus improved power pulses 52 derived herein. Since the gate pulse 52 is wider and more intense at the zero crossover point, switch 22 is reliably latched on. Zero phase turn on circuit 7 has a mechanism for adjusting the pulse turn on width.

Figure 10:
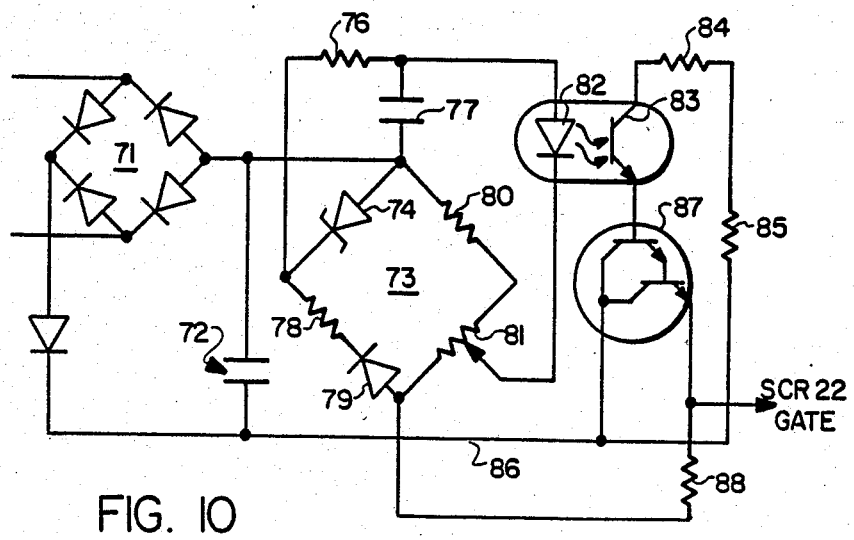
FIG. 10 shows circuit 7 of FIG. 1 in more detail.

The zero phase turn on circuit 7 is shown in more detail in FIG. 10 and comprises AC nodes 41' of bridge 71 connected to secondary 42 of transformer 40 and capacitor 72 connected between the negative node of bridge 71 and line 86. That node is also connected to bridge 73 one arm of which comprises diode 74 having series connected resistor 76 and capacitor 77 connected in parallel thereto. Connected to the junction of diode 74 and resistor 76 is a series combination of resistor 78 and zener diode 79 forming a second leg of the bridge. Connected to the junction of capacitor 77 and diode 74 is a resistor 80 forming a third leg of the bridge and connected between resistor 80 and diode 79 forming the fourth leg of the bridge is potentiometer 81 having a wiper arm connected to one side of light emitting diode 82 the other side of which is connected to the junction of resistor 76 and capacitor 77. Light emitting diode 82 operates in conjunction with phototransistor 83 which has its collector connected through resistors 84 and 85 to line 86 and its emitter connected to the base of Darlington pair 87. The collector of Darlington pair 87 is connected to line 86 and the emitter is connected through resistor 88 to the node of bridge 73 formed by the junction of potentiometer 81 and diode 79. The emitter of Darlington pair 87 also forms the output of the zero phase turn on circuit 7 connected to SCR 22.

Potentiometer 81 adjusts the width of the gate turn on pulse supplied to the gate of SCR 22. This circuit supplies the pulse 52 shown in FIG. 3 regardless of whether voltage or current is leading. Rectified half wave pulses are present across the DC arms of bridge 71 and also across the input arms of bridge 73. Simultaneous half wave signals occur across both series elements 80, 81 and series elements 74, 78 and 79. A differential voltage is obtained between the junction of diode 74 and resistor 78 and the variable tap of potentiometer 81 for energizing LED 82. Varying potentiometer 81 establishes an optimized pulse height and width, once potentiometer 81 is set no further adjustment is necessary. The aforementioned differential voltage pulse is further conditioned by elements 76, 77 and the clipping action of the diode junctions as current flows through diode 82, the conditioning action provides both the required pulse shape and phase shift appropriate for zero crossover firing.

The function of diode 110 is to isolate the unfiltered half wave pulses from the DC voltage occurring across capacitor 72. The function of capacitor 72 is to filter or smooth the half wave pulses to provide DC power for the operation of elements 83 and 87.

SCR 29 and capacitor 25 operate as a turn off arrangement to force SCR 22 out of conduction at a predetermined phase angle of the current and/or voltage cycle as established by phase turn off circuit 8. When SCR 22 is fired to initiate load current, capacitor 25 charges by way of choke 31 and makeup source 30 through SCR 22 and winding 26. When SCR 29 is fired at the desired phase, the resultant sudden in-rush of current into capacitor 25 drops the anode voltage of SCR 22 below the forward voltage drop across SCR 22 and winding 26 allowing SCR 22 to regain its forward blocking ability thus forming SCR 22 out of conduction. Inductor 26 offers a high impedance to the sharp wavefront incurred by the sudden decrease of current through SCR 22 at the moment of commutation. The resultant voltage drop across inductor 26 is in series with and aiding the voltage drop across SCR 22, thereby greatly enhancing the commutation action of capacitor 25 when SCR 29 discharges said capacitor.

Figure 4:
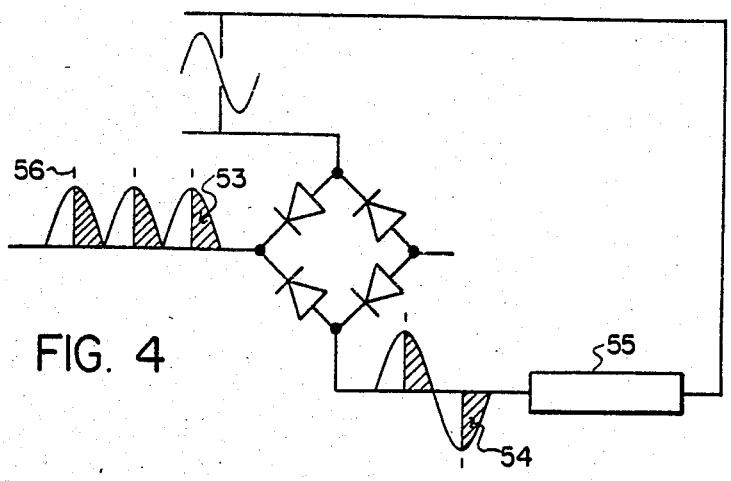
FIG. 4 shows voltage time characteristics as related to the positive DC arm and the AC load input arm of the bridge rectifier portion of the circuitry shown in FIG. 1 when the associated circuitry is operated in a switching mode, the shaded portion of the indicated wave form being the non-conductive period of the switching cycle.

FIG. 4 depicts half cycle waves appearing at terminals 24 of bridge 18 and full cycle waveforms appearing at load line 20 when SCR 22 is operating under forced commutation. The shaded portions of waveforms 53 and 54 respectively indicate non-conduction periods at terminal 24 of bridge 18 and load conductor 12 of fluorescent lighting load 55 occurring when SCR 22 is non conductive. The moment of forced commutation 56 can be varied thus controlling the amount of energy channeled into the load components 14, 15 and 16 which make up load 55 and also controlling the resulting fluorescent light level.

Figure 11:
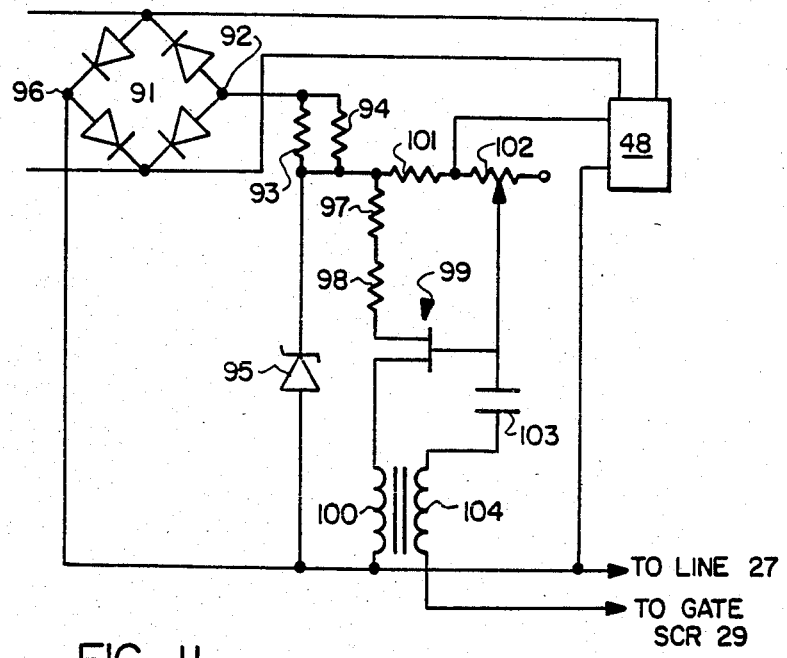
FIG. 11 shows circuit 8 of FIG. 1 in more detail.

Gate control of SCR 29 is provided by phase turn off 8 which is shown in more detail in FIG. 11. This circuit comprises a rectifying bridge 91 which is connected to secondary 43 of transformer 40. The input lines from secondary 43 are also connected to line voltage compensation 48 which may be included if desired. Line voltage compensation circuit 48 can sense any decrease in the AC input to AC input terminals 43' to apply the necessary time advance or time retard to the pulse actuating the gate of SCR 29 thus maintaining constant light levels even as power on the lines vary. Output node 92 of bridge 91 is connected to one side of the parallel combination of resistors 93 and 94 the other side of which is connected through zener diode 95 to the other output node 96 of bridge 91. The junction of the parallel combination of resistors 93 and 94 and zener 95 is connected by way of resistors 97 and 98 to one base of unijunction transistor 99 the other base of which is connected through winding 100 to node 96. The above mentioned junction is also connected through resistor 101 to potentiometer 102 the wiper arm of which is connected to the emitter of unijunction transistor 99. The emitter of unijunction transistor 99 is also serially connected through capacitor 103 and winding 104, to the gate of SCR 29. Winding 104 is inductively coupled to winding 100. Potentiometer 102 can select the phase at which SCR 29 is to be turned on so that SCR 22 will turn off to thus control dimming. When the selected phase is reached, the energy stored in capacitor 103 is discharged through unijunction 99 and windings 100 and 104 to generate a turn on pulse for SCR 29.

Instead of the circuit shown in FIG. 11, a digital approach can be taken. The digital arrangement can then be easily controlled by a microprocessor or computer for dimming adjustment from a remote location.

Figure 5:
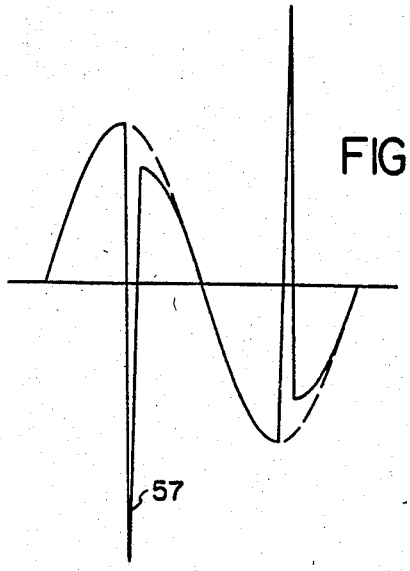
FIG. 5 is a graphical representation showing the counter electromotive force spike type wave across the input connections of a rapid start ballast fluorescent lighting load when it is subjected to predetermined sinusoidal switch offs.

FIG. 5 depicts a typical counter electromotive force flyback spike (waveform 57) occurring across load control conductor 12 and load neutral conductor 13 upon the turn off of SCR 22 if circuits 4, 5 and 6 are omitted from the arrangement shown in FIG. 1. The high amplitude spike 57 crosses the base line and extends beyond the nominal waveform envelope. This abrupt excursion of high amplitude causes severe component stress and high RFI levels resulting in high acoustic noise levels from the ballast laminations.

Figure 6:
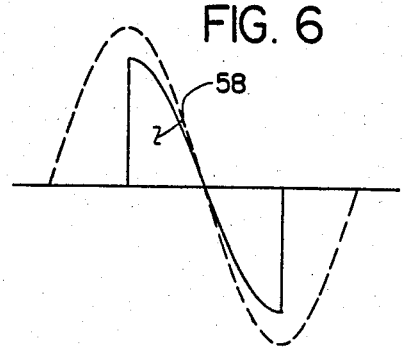
FIG. 6 is a graphical representation showing the voltage time relationship of the bypass sinusoidal wave segment as it occurs across the partial bypass elements of the present invention during the predetermined switch off interval of the switching means.

FIG. 6 detects a bypass waveform consisting of a partial sinusoidal wave segment 58 which appears across load control conductor 12 and load neutral conductor 13 during the non-conducting time of SCR 22 due to the shunt or bypass action of partial bypass circuit 4 if circuits 5 and 6 are not included in the system as shown in FIG. 1. Of course, waveform 58 will change depending upon the phase turn off point of SCR 22. Switch 33 is set depending upon the number of fluorescent fixtures included as a load in order to optimize the value of the current leading capacitors 32 and thereby to achieve an amplitude adjustment of waveform 58.

Figure 7:
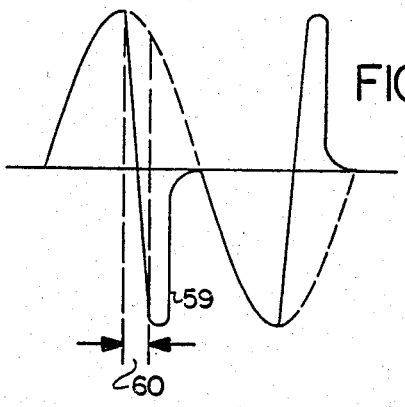
FIG. 7 is a graphical representation showing the voltage time relationship of the waveforms resulting from the combining of the counter electromotive force spike type wave shown in FIG. 5 and the sinusoidal wave segment shown in FIG. 6.

FIG. 7 shows a waveform 59 which is a composite of the waveforms 57 and 58 shown in FIGS. 5 and 6 respectively. Thus, waveform 59 is the resultant combination of waveforms 57 and 58 that occurs when partial bypass means 4 is connected between load control conductor 12 and load neutral conductor 13 with circuits 5 and 6 omitted. Waveform 59 has sufficient width, amplitude and wave front taper of the leading edge to function as a usable power pulse when applied to rapid start ballast circuitry. Without further modification by circuits 5 and 6, waveform 59 by itself can contribute to maintaining fluorescent tube heater voltages during the turn off period of SCR 22 and can also contribute to higher RMS load voltages thereby enhancing fluorescent tube ignition and drop out parameters. Switch 33 achieves a degree of control over waveform 58 providing a means for adjusting the amount of bypass energy. The higher RMS load voltage in fluorescent tube heater voltages resulting from waveform 59 provides enhanced fluorescent tube ignition thus permitting individual switching of fluorescent fixtures at low light levels downstream from the controller. Effective dimming control is still maintained because of the variable off time provided by adjustable time segment 60 wherein the wave amplitude is below the fluorescent tube ignition voltage.

Figure 8:
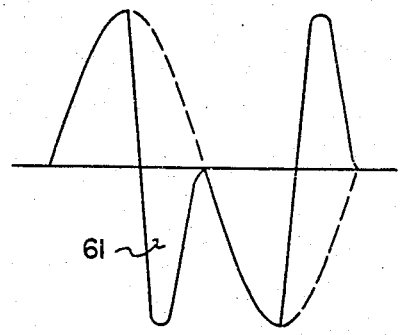
FIG. 8 is a graphical representation of the further development of the waveform shown in FIG. 7 due to conditioning by circuit 5 of FIG. 1.

FIG. 8 depicts waveform 61 showing how the straight trailing edge of waveform 59 in FIG. 7 is transformed into a tapered trailing edge waveform by the addition of the capacitive component network 5 into FIG. 1 circuitry but still omitting inductive component network 6. This further reenforcing of waveform 59 in FIG. 7 to achieve the quasi-sinusoidal type of waveform 61 in FIG. 8 increases the resultant power pulse capability. The trailing edge taper achieved in waveform 61 of FIG. 8 reduces ballast noise level due to the elimination of the sharp trailing edge wave front.

Figure 9:
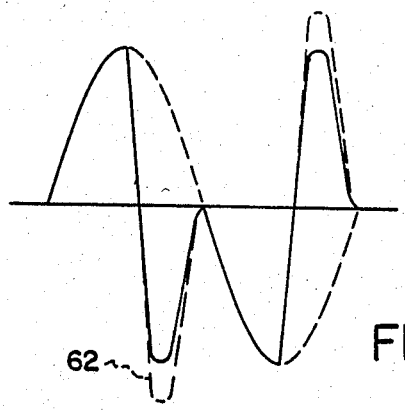
FIG. 9 is a graphical representation of the increase in amplitude of the quasi-sinusoidal power pulse indicated in FIG. 8 when further conditioned by circuit 6 shown in FIG. 1.

FIG. 9 shows waveform 62 and its increased amplitude over the waveform 61 shown in FIG. 8 that results from the addition of inductive component network 6. The additional inductance 38 increases the amplitude of waveform 61 to an amount determined by switch 39 and the chosen incremental tap of inductance 38.

The embodiments of the invention in which an exclusive property or right is claimed are defined as follows:

1. A dimming system for a fluorescent tube wherein counter electromotive forces generated at switch off of said tube are used to maintain filaments of said fluorescent tube heated during switch off of said tube, said dimming system comprising:

source terminals for connection to a source of power, said power having zero phases;

load terminals for connection to a load having at least one fluorescent tube;

switch means connected to said source terminals and to said load terminals for controlling the supply of power to said load terminals;

zero phase firing means connected to said switch means for energizing said switch means to supply power to said load terminals at said zero phases;

phase turn off means connected to said switch means for deenergizing said switch means to switch off power to said load terminals at phases of said power other than zero phases; and, switch off filament heating means connected to said switch means for converting counter electromotive forces generated at switch all of said tube into power for supply to said filaments during said switch off.

2. The dimming system of claim 1 wherein said switch off filament heating means comprises bypass capacitor means connected to said switch means for supplying a switch off power pulse comprised of a portion of said power bypassed around said switch means by said bypass capacitor means added to spikes generated by said counter electromotive forces for providing heating of the filaments of said fluorescent tube during switch off.

3. The dimming system of claim 2 wherein said switch off filament heating means comprises current leading wave shaping means connected to said switch means for tapering a trailing edge of said switch off power pulse supplied to said load terminals.

4. The dimming system of claim 3 wherein said switch off filament heating means comprises current lagging wave shaping means for increasing the amplitude of said switch off power pulse.

5. The dimming system of claim 4 wherein said current leading wave shaping means comprises at least one capacitor.

6. The dimming system of claim 5 wherein said current lagging wave shaping means comprises at least one inductor.

7. The dimming system of claim 1 wherein said switch means comprises gate controlled switch means for supplying power to said load terminals when a gate of said gate controlled switch means is energized.

8. The dimming system of claim 7 wherein said switch means comprises means for connecting said zero phase firing means to the gate of said gate controlled switch means for turning on said switch at said zero phases and for connecting said phase turn off means across said gate controlled switch means for commutating said gate controlled switch means at said phases other than said zero phases.

9. The dimming system of claim 8 wherein said switch off filament heating means comprises bypass capacitor means connected to said switch means for supplying a switch off power pulse comprised of a portion of said power bypassed around said switch means by said bypass capacitor means added to spikes generated by said counter electromotive forces for providing heating of the filaments of said fluorescent tube during switch off.

10. The dimming system of claim 9 wherein said switch off filament heating means comprises current leading wave shaping means connected to said switch means for tapering a trailing edge of said switch off power pulse supplied to said load terminals.

11. The dimming system of claim 10 wherein said switch off filament heating means comprises current lagging wave shaping means for increasing the amplitude of said switch off power pulse.

12. The dimming system of claim 11 wherein said current leading wave shaping means comprises at least one capacitor.

13. The dimming system of claim 12 wherein said current lagging wave shaping means comprises at least one inductor.

14. The dimming system of claim 13 wherein said gate controlled switch means comprises a bridge connected between said source terminals and said load terminals and an SCR connected across said bridge for controlling current flow therethrough.

15. The dimming system of claim 1 wherein said switch off filament heating means comprises current leading wave shaping means connected to said switch means for tapering a trailing edge of said switch off power pulse suplied to said load terminals.

16. The dimming system of claim 1 wherein said switch off filament heating means comprises current lagging wave shaping means for increasing the amplitude of said switch off power pulse.

* * * * *

UNITED STATES PATENT OFFICE

CERTIFICATE OF CORRECTION

PATENT NO. : 4,568,857

DATED : February 4, 1986

INVENTOR(S) : William J. Head

It is certified that error appears in the above-identified patent and that said Letters Patent are hereby corrected as shown below:

In Column 8, line 15, delete "all" and insert --off--.

Signed and Sealed this

*Twenty-ninth* Day of *April 1986*

[SEAL]

*Attest:*

DONALD J. QUIGG

*Attesting Officer*

*Commissioner of Patents and Trademarks*